US010697243B2

(12) United States Patent
Lee et al.

(10) Patent No.: US 10,697,243 B2
(45) Date of Patent: Jun. 30, 2020

(54) COILED TUBING RIG

(71) Applicant: Nabors Drilling Technologies USA, Inc., Houston, TX (US)

(72) Inventors: Denver Lee, Houston, TX (US); Donovan Korach, Houston, TX (US); Ashish Gupta, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 179 days.

(21) Appl. No.: 15/642,943

(22) Filed: Jul. 6, 2017

(65) Prior Publication Data

US 2018/0016855 A1 Jan. 18, 2018

Related U.S. Application Data

(60) Provisional application No. 62/361,904, filed on Jul. 13, 2016, provisional application No. 62/362,422, filed on Jul. 14, 2016.

(51) Int. Cl.

| | |
|---|---|
| ***E21B 7/02*** | (2006.01) |
| ***E21B 15/00*** | (2006.01) |
| ***E21B 19/22*** | (2006.01) |

(52) U.S. Cl.

CPC ..... *E21B 7/023* (2013.01); *E21B 7/024* (2013.01); *E21B 15/003* (2013.01); *E21B 19/22* (2013.01)

(58) Field of Classification Search

CPC ..... E21B 7/023; E21B 19/22

See application file for complete search history.

(56) References Cited

U.S. PATENT DOCUMENTS

| | | | | |
|---|---|---|---|---|
| 3,835,940 | A * | 9/1974 | Winter, Jr. | E21B 7/02 173/147 |
| 4,249,600 | A * | 2/1981 | Bailey | E21B 19/22 166/77.2 |
| 5,174,389 | A * | 12/1992 | Hansen | E21B 19/146 175/52 |
| 5,839,514 | A * | 11/1998 | Gipson | E21B 19/22 166/384 |
| 6,273,188 | B1 * | 8/2001 | McCafferty | E21B 19/22 166/77.2 |
| 2013/0319674 | A1 * | 12/2013 | Boudreaux | E21B 19/00 166/297 |
| 2018/0274311 | A1 * | 9/2018 | Zsolt | E21B 41/00 |

* cited by examiner

*Primary Examiner* — D. Andrews
(74) *Attorney, Agent, or Firm* — Adolph Locklar

(57) ABSTRACT

A coiled tubing rig includes a skid, a mast, and a drill floor. The mast may be pivotably coupled to the skid and may be moved between a horizontal position and a vertical position by a hydraulic cylinder. The drill floor may be pivotably coupled to the mast. The drill floor may be moved from a retracted to a deployed position by a hydraulic cylinder. The skid may include a BOP cradle and BOP controls. The coiled tubing rig may include a jib which may telescopically or pivotably extend from the mast. The coiled tubing rig may include a coiled tubing injector which is slidably positionable between a retracted and a deployed position.

26 Claims, 8 Drawing Sheets

COILED TUBING RIG

CROSS-REFERENCE TO RELATED APPLICATIONS

This application is a nonprovisional application that claims priority from U.S. provisional application No. 62/361,904, filed Jul. 13, 2016, and from U.S. provisional application No. 62/362,422, filed Jul. 14, 2016, both of which are hereby incorporated by reference.

TECHNICAL FIELD/FIELD OF THE DISCLOSURE

The present disclosure relates generally to wellsite equipment, and specifically to coiled tubing rigs.

BACKGROUND OF THE DISCLOSURE

During well intervention or certain drilling operations, a coiled tubing string may be utilized. A coiled tubing string is made up of a long length of metallic pipe with one or more downhole tools, known as a bottom hole assembly (BHA), positioned on the end of the coiled tubing string which is to be inserted into the wellbore. The coiled tubing string is inserted into the wellbore by a coiled tubing rig. Typically, the coiled tubing rig includes a mast which is centered directly over the wellhead of the wellbore with a coiled tubing injector also located in line with the mast. Typically, the coiled tubing rig includes a drill floor at the bottom end of the mast which may be integrated with the coiled tubing rig skid itself.

SUMMARY

The present disclosure provides for a coiled tubing rig. The coiled tubing rig may include a skid, a mast mechanically coupled to the skid, and a drill floor mechanically coupled to the mast.

The present disclosure also provides for a method. The method may include a coiled tubing rig. The coiled tubing rig may include a skid, a mast mechanically coupled to the skid, and a drill floor mechanically coupled to the mast. The method may further include transporting the coiled tubing rig to a wellhead, extending the drill floor from a retracted position to a deployed position, and raising the mast from a horizontal position to a vertical position.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
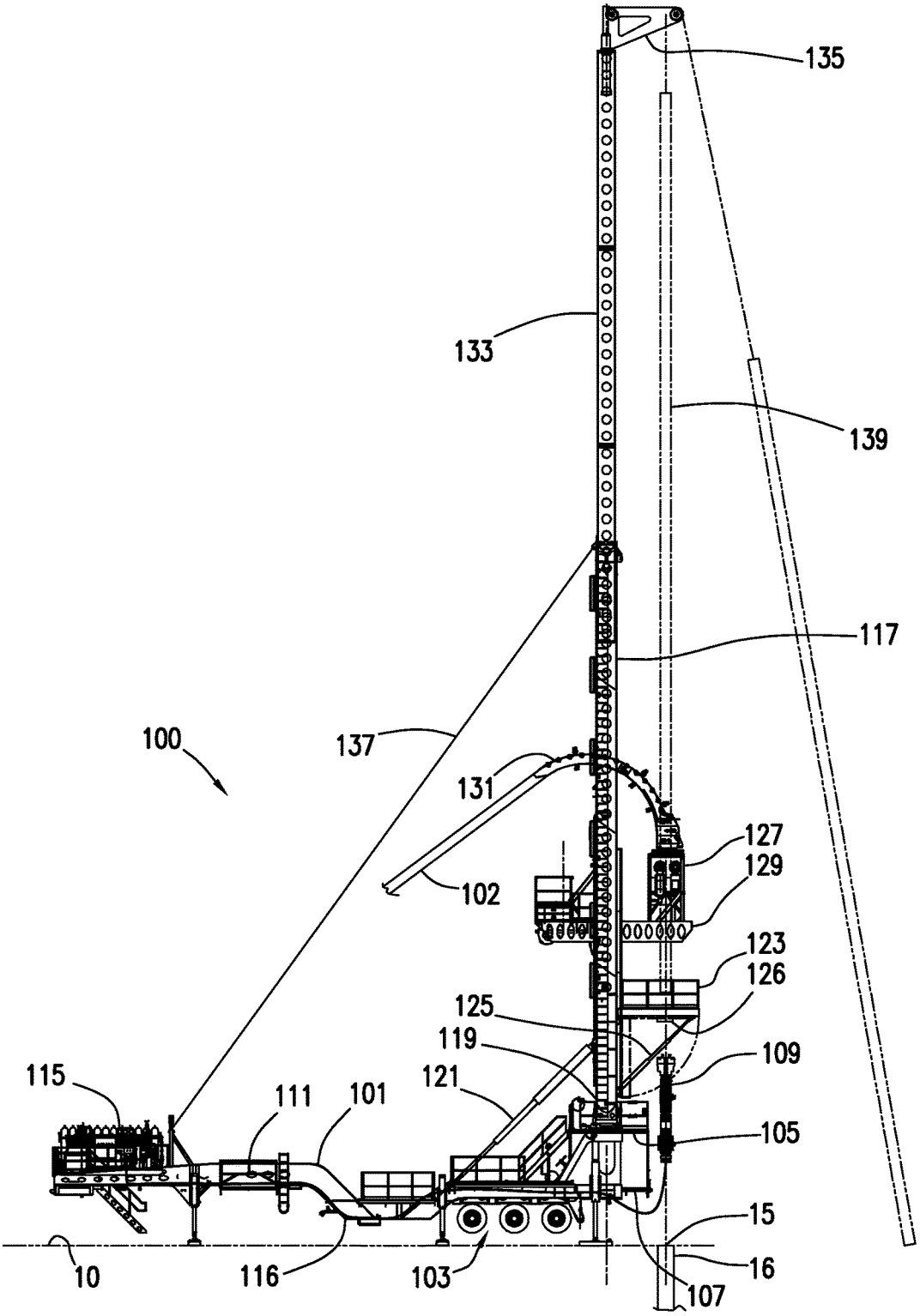
FIG. 1 depicts a coiled tubing rig consistent with at least one embodiment of the present disclosure in a deployed position.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIGS. 1-5 depict coiled tubing rig 100. Coiled tubing rig 100 may be used to drill or perform other services on wellbore 16 through wellhead 15. Coiled tubing rig 100 may include skid 101. Skid 101 may be coupled to or formed integrally with trailer 103. In some embodiments, skid 101 may be formed as a part of trailer 103. Trailer 103 may be used, for example and without limitation, for transportation of coiled tubing rig 100. In some embodiments, skid 101 may include lower drill floor 105. In some embodiments, skid 101 may include BOP cradle 107. BOP cradle 107 may, for example and without limitation, be used to hold BOP 109 for transport and storage on skid 101. In some embodiments, BOP cradle 107 may include a test stump (not shown) which may be used to pressure test BOP 109. In some embodiments, skid 101 may include coiled tubing reel holder 111 which may be utilized to transport and store a coiled tubing reel. In other embodiments, coiled tubing string 102 may be introduced from a coiled tubing reel positioned on another trailer or otherwise at the wellsite. In some embodiments, skid 101 may include BOP control unit 115. BOP control unit 115 may be operatively coupled with BOP 109 by one or more hoses 116 or other connections to operate BOP 109 when BOP 109 is coupled to wellhead 15 of wellbore 16 with which coiled tubing rig 100 is to be used. In some embodiments, hoses 116 may be coupled between BOP 109 and BOP control unit 115 during transportation, rigging up, and operation of coiled tubing rig 100.

Figure 2:
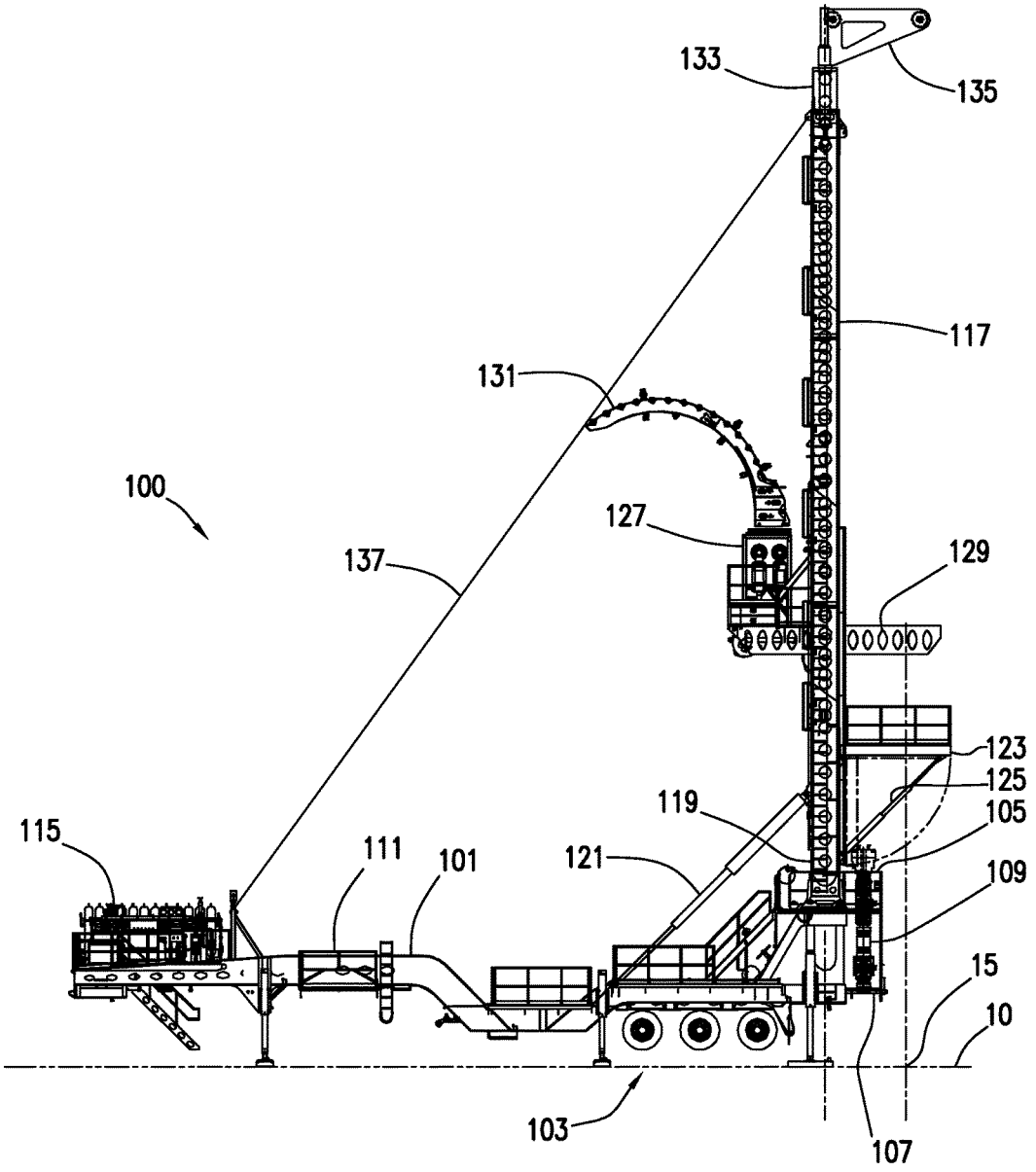
FIG. 2 depicts the coiled tubing rig of FIG. 1 in a partially deployed position.
Figure 3:
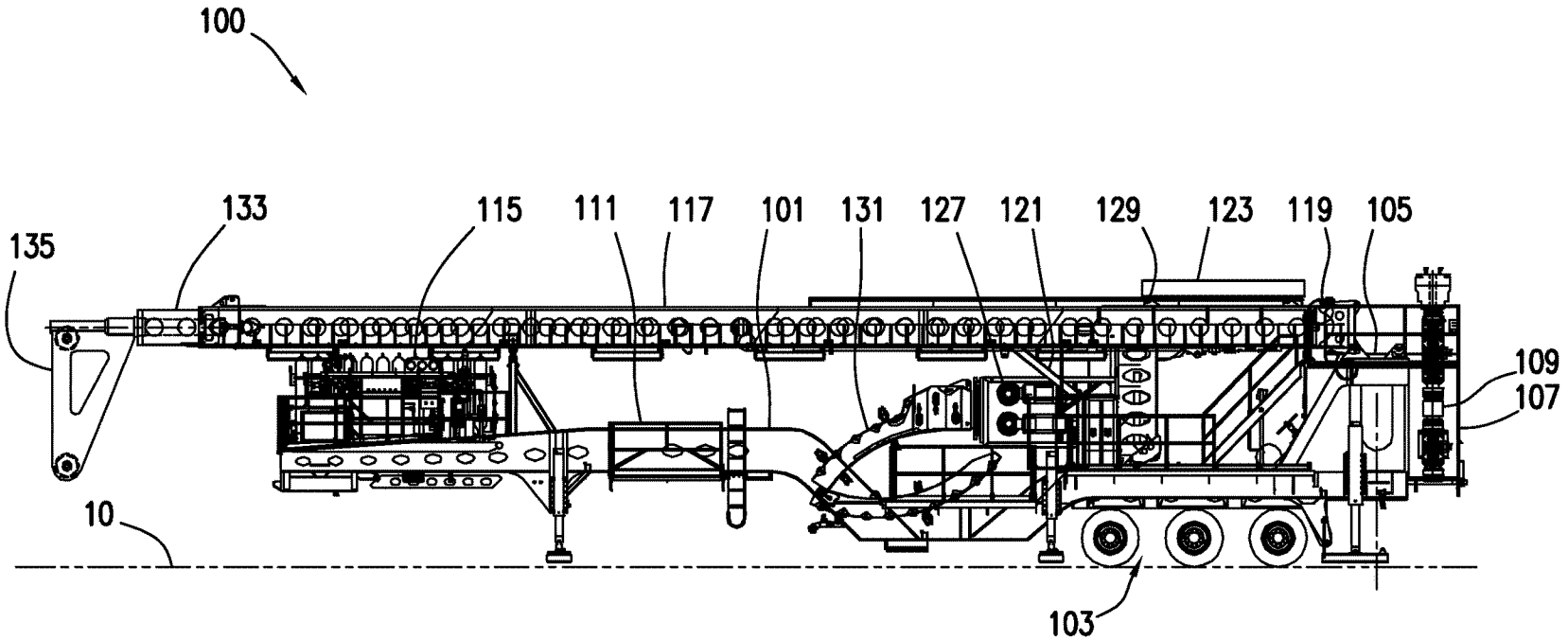
FIG. 3 depicts the coiled tubing rig of FIG. 1 in a transport position.
Figure 4:
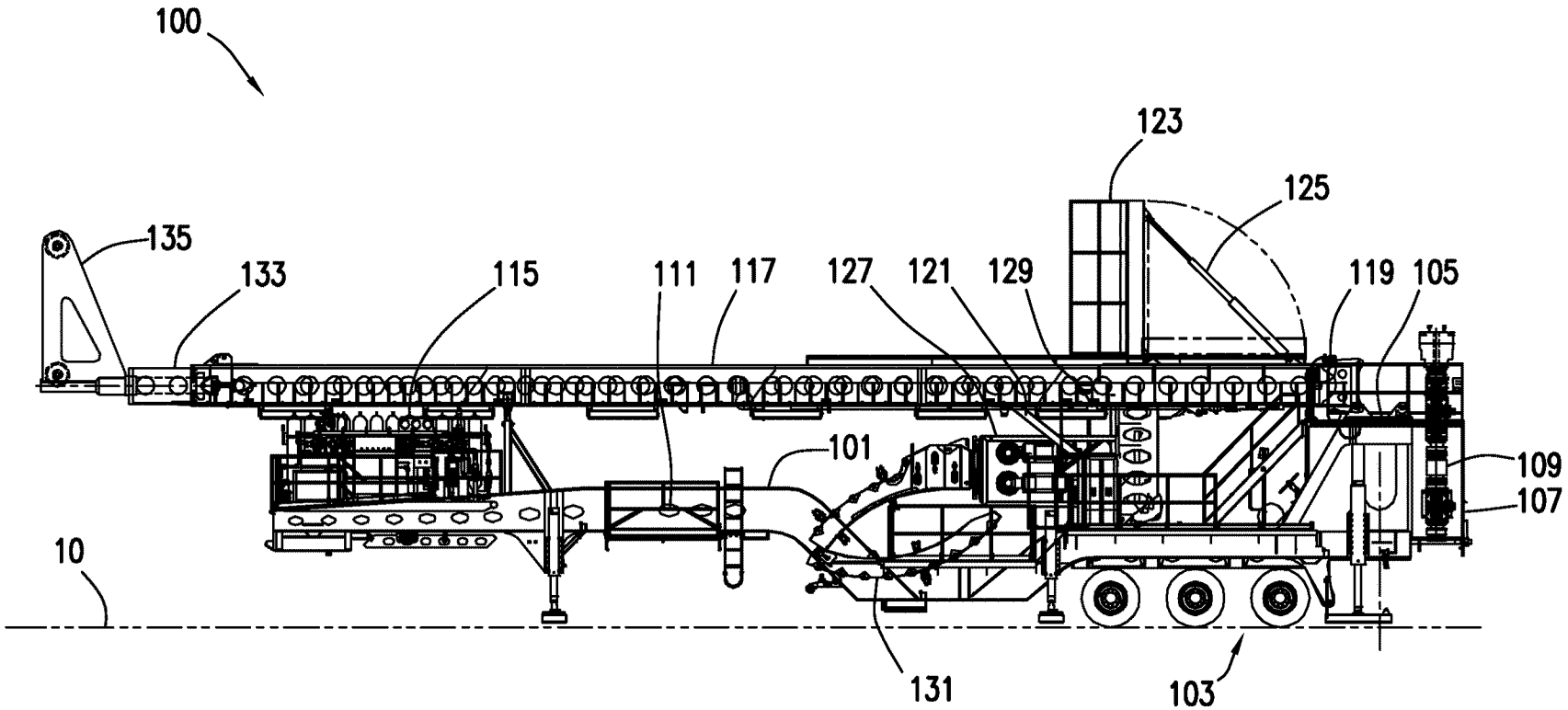
FIG. 4 depicts the coiled tubing rig of FIG. 1 in a partially deployed position.
Figure 5:
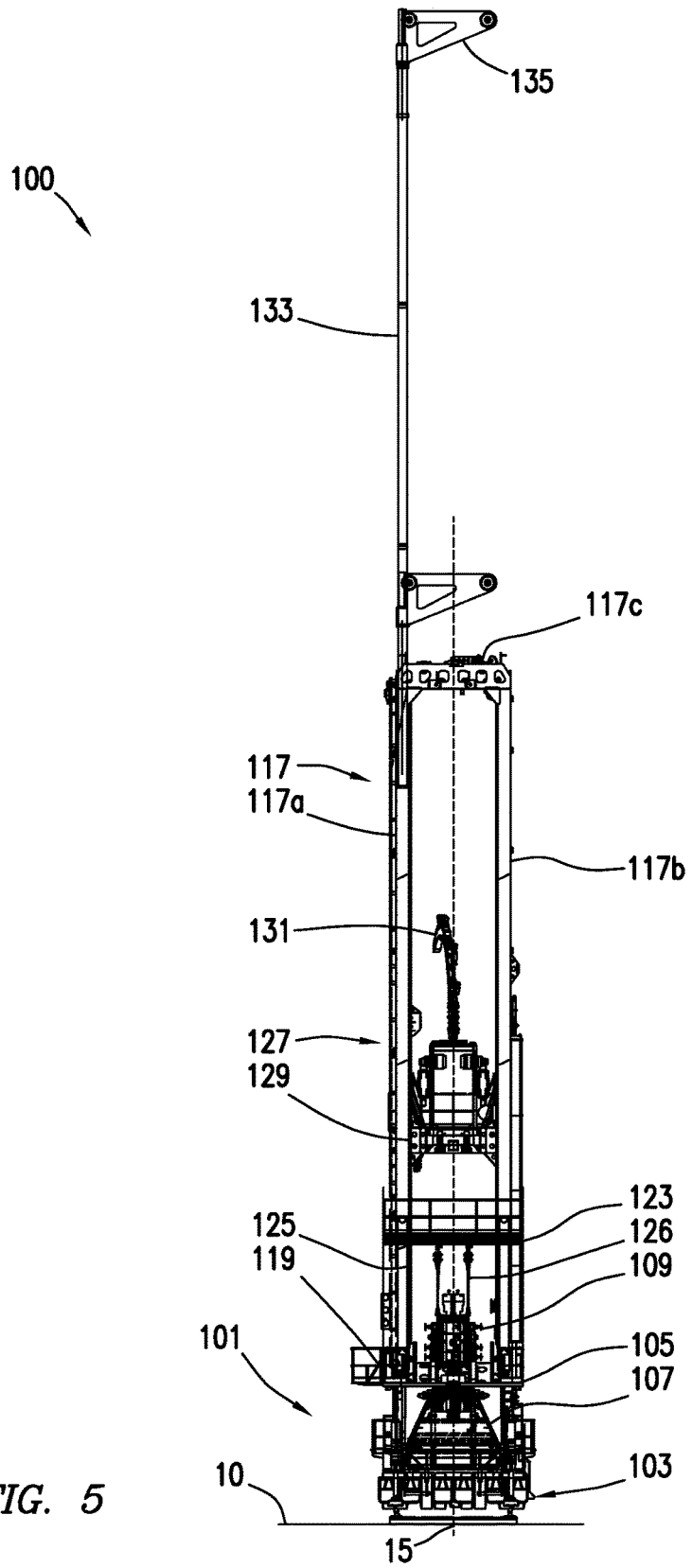
FIG. 5 depicts an end view of the coiled tubing rig of FIG. 1.

Coiled tubing rig 100 may include mast 117. Mast 117 may be pivotably coupled to skid 101 at mast pivot 119. Mast 117 may, in some embodiments, be formed from one or more members such as, as depicted in FIG. 5, mast sides 117*a*, 117*b* and mast top 117*c*. Mast 117 may be mechanically coupled to skid 101 by hydraulic cylinder 121, positioned to move mast 117 between the vertical position depicted in FIGS. 1, 2, and 5, and a horizontal position as depicted in FIGS. 3 and 4. In other embodiments, mast 117 may be moved by a winch or any other raising mechanism.

In some embodiments, mast 117 may include drill floor 123. Drill floor 123 may be pivotably coupled to mast 117. In some embodiments, drill floor 123 may be mechanically coupled to mast 117 by drill floor hydraulic cylinder 125. Drill floor hydraulic cylinder 125 may move drill floor 123 between a transport position as depicted in FIG. 3 and a deployed position as depicted in FIGS. 1, 2, and 4. In some embodiments, drill floor 123 may be moved by a winch or any other raising mechanism. In some embodiments, drill floor 123 may be positioned above ground 10 a sufficient distance to allow an anticipated clearance over wellhead 15 when a Christmas tree or BOP 109 is coupled to wellhead 15. In some embodiments, because drill floor 123 is located at a further distance above ground 10 than on a conventional rig, coiled tubing rig 100 may utilize a BOP 109 that is taller or includes more components than would otherwise be available. In some embodiments, drill floor 123, when in the deployed position, may extend over wellhead 15. In some embodiments, coiled tubing rig 100 may include BOP hoist system 126. BOP hoist system 126 may be utilized to lift and position BOP 109 above wellhead 15. In some embodiments, BOP hoist system 126 may be positioned on the underside of or mechanically coupled to drill floor 123.

In some embodiments, coiled tubing rig 100 may include coiled tubing injector 127. Coiled tubing injector 127 may be used to inject coiled tubing string 102 into wellbore 16. In some embodiments, coiled tubing injector 127 may be mechanically coupled to mast 117 by injector boom 129. Coiled tubing injector 127 may be mechanically coupled to injector boom 129 such that coiled tubing injector 127 is slidable relative to injector boom 129. In some embodiments, coiled tubing injector 127 may be repositioned between a deployed position as depicted in FIG. 1 and a retracted position as depicted in FIG. 2. In some embodiments, when in the deployed position, coiled tubing injector 127 may be positioned over wellhead 15. When in the retracted position, coiled tubing injector 127 may be positioned out of alignment with wellhead 15. By moving coiled tubing injector 127 out of alignment with wellhead 15, wellbore equipment 139 such as a BHA or components thereof, as depicted in FIG. 1, may be positioned in line with wellhead 15 using hoisting boom 135 as further discussed below. Because coiled tubing injector 127 is out of alignment with wellhead 15, wellbore equipment 139 may be added as one or more longer components than in a case where coiled tubing injector 127 remained in line with wellhead 15. In some embodiments, coiled tubing injector 127 may be positioned in the retracted position for transport as depicted in FIGS. 3 and 4. In some embodiments, coiled tubing injector 127 may include tubing guide arch 131, which may be collapsible as depicted in FIGS. 3 and 4 for storage during transportation. In some embodiments, coiled tubing injector 127 may be adjusted in height above ground 10. In some embodiments, coiled tubing injector 127 may be adjusted side-to-side. In some such embodiments, coiled tubing injector 127 may move relative to injector boom 129 upwards and downwards as well as side-to-side. In some embodiments, injector boom 129 may move upwards or downwards relative to mast 117.

Figure 6:
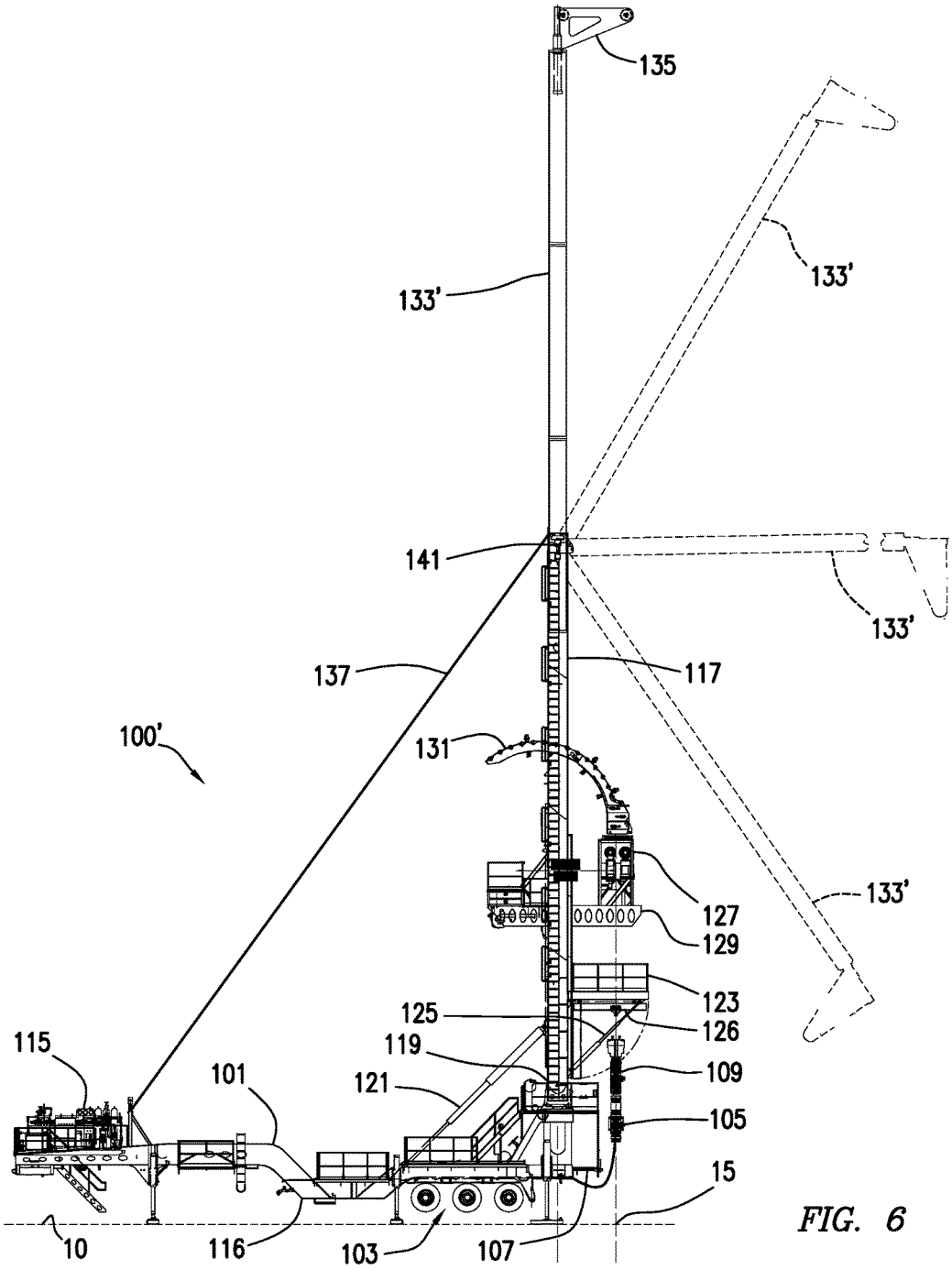
FIG. 6 depicts a coiled tubing rig consistent with at least one embodiment of the present disclosure.
Figure 7:
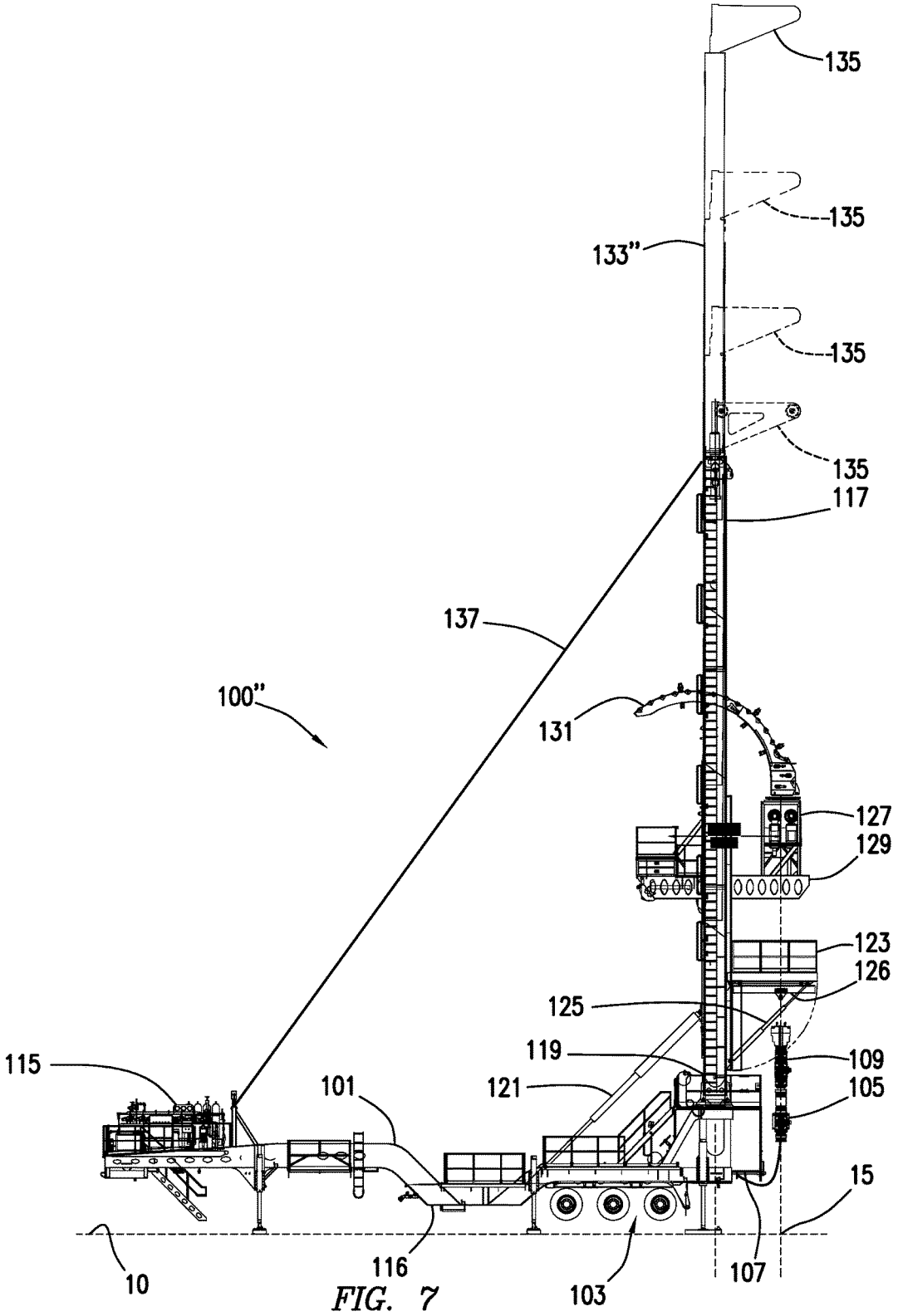
FIG. 7 depicts a coiled tubing rig consistent with at least one embodiment of the present disclosure.

In some embodiments, coiled tubing rig 100 may include jib 133. Jib 133 may be an extension above mast 117. Jib 133 may be coupled to one of mast sides 117*a*, 117*b* as depicted in FIG. 5. In some embodiments, as depicted in FIG. 6, jib 133' may be deployed from mast 117 of coiled tubing rig 100' and retracted by pivoting relative to mast 117. In some such embodiments, jib 133' may be pivotably coupled to mast 117 by jib pivot 141. In some embodiments, as depicted in FIG. 7, jib 133" may be deployed from mast 117 of coiled tubing rig 100" and retracted by telescoping out of or into mast 117. In some embodiments, jib 133 or mast 117 may include hoisting boom 135. Hoisting boom 135 may be positioned at the top of mast 117 or jib 133. In some embodiments, hoisting boom 135 may extend from mast 117 to a position over wellhead 15. Hoisting boom 135 may be utilized to, for example and without limitation, position one or more pieces of drilling equipment including wellbore equipment 139 as depicted in FIG. 1, over wellhead 15 and introduce wellbore equipment 139 into wellbore 16. In some embodiments, for example, wellbore equipment 139 may be positioned into wellbore 16 through wellhead 15, and may then be mechanically coupled to coiled tubing string 102 to be extended into wellbore 16 through wellhead 15. In some embodiments, hoisting boom 135 may be coupled to jib 133 such that it can rotate or pivot relative to jib 133 between a deployed position in which hoisting boom 135 is in alignment with wellhead 15 and a retracted position in which hoisting boom 135 is not in alignment with wellhead 15. In such an embodiment, an additional crane (not shown) may be used to position wellbore equipment 139 or otherwise introduce equipment through wellhead 15 without interfering with mast 117, jib 133, and hoisting boom 135 as they are positioned out of alignment with wellhead 15. In some embodiments, hoisting boom 135 may rotate or pivot to other positions out of alignment with wellhead 15, and may be used for handling components from the ground near wellhead 15. For example and without limitation, hoisting boom 135 may hoist wellbore equipment 139 from a position out of alignment with wellhead 15 and then be rotated or pivoted until wellbore equipment 139 is in alignment with wellhead 15. In some embodiments, jib 133 may allow hoisting boom 135 to be positioned at a height above ground 10 to accommodate the height of an anticipated BHA or other component of wellbore equipment 139.

Figure 8:
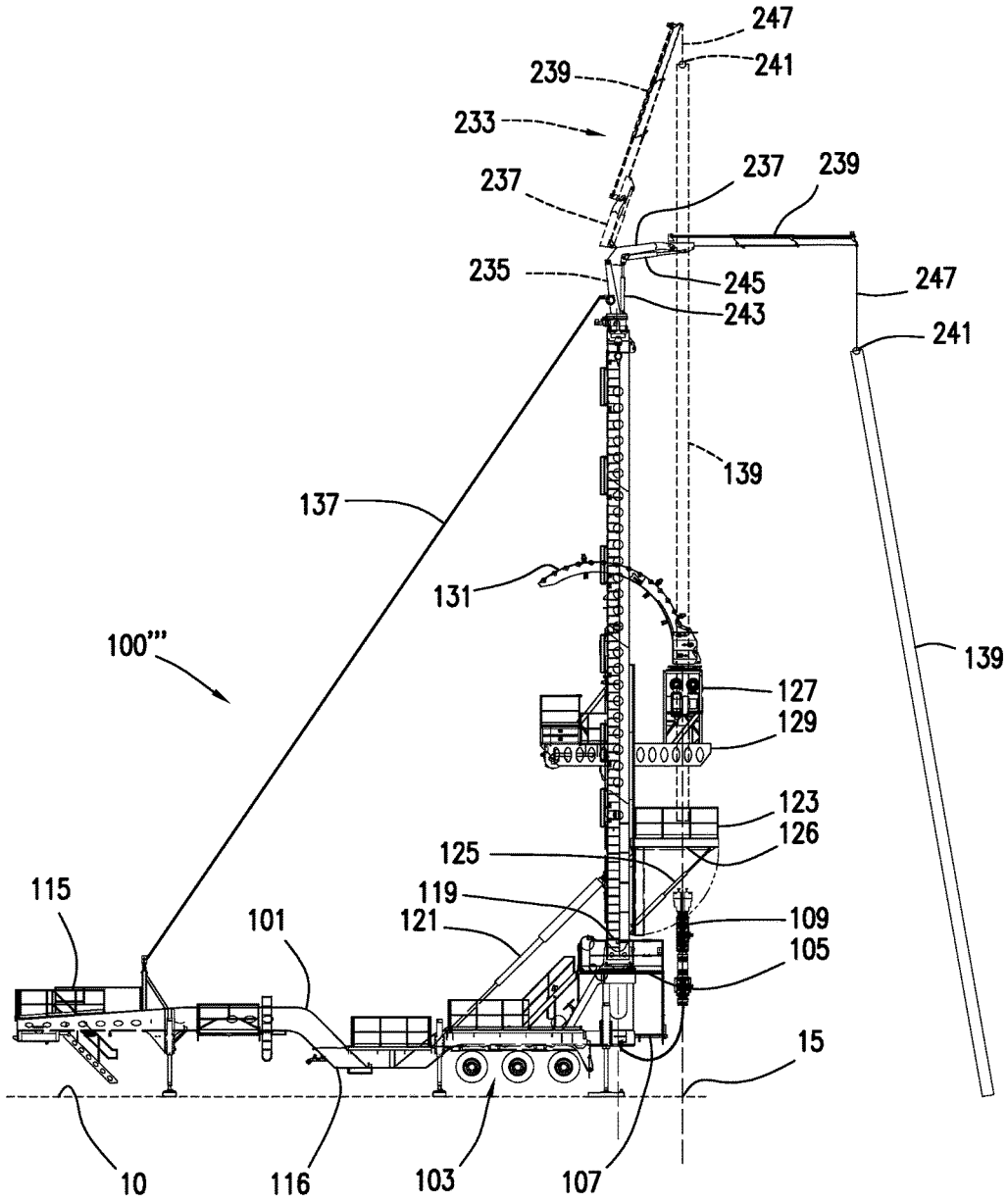
FIG. 8 depicts a coiled tubing rig consistent with at least one embodiment of the present disclosure.

In some embodiments, as depicted in FIG. 8, coiled tubing rig 100''' may include knuckleboom crane 233. Knuckleboom crane 233 may be mechanically coupled to the top of mast 117 of coiled tubing rig 100'''. Knuckleboom crane 233 may include base or column 235. Column 235 may be mechanically coupled to mast 117. In some embodiments, column 235 may allow knuckleboom crane 233 to rotate relative to mast 117. In some embodiments, knuckleboom crane 233 may include inner boom 237 pivotably coupled to column 235. In some embodiments, knuckleboom crane 233 may include outer boom 239 pivotably coupled to inner boom 237. In some embodiments, one or both of inner boom 237 and outer boom 239 may be telescopic booms. In some embodiments, inner boom cylinder 243 may be positioned to articulate inner boom 237 relative to column 235. In some embodiments, outer boom cylinder 245 may be positioned to articulate outer boom 239 relative to inner boom 237. In some embodiments, knuckleboom crane 233 may include hoisting fixture 241 such as a hook supported from outer boom 239 by hoisting line 247 and used to couple wellbore equipment to knuckleboom crane 233. Knuckleboom crane 233 may be used to, for example and without limitation, position one or more pieces of drilling equipment including wellbore equipment 139 over wellhead 15 and introduce wellbore equipment 139 into wellbore 16 as described with respect to hoisting boom 135. Additionally, inner boom 237 and outer boom 239 may be articulated or rotated to allow for movement and positioning of wellbore equipment 139 relative to coiled tubing rig 100'''. In some embodiments, inner boom 237 and outer boom 239 may be positionable in a retracted position to allow for transport of coiled tubing rig 100.

Coiled tubing rig 100 may be transported in a transport configuration as depicted in FIG. 3. In the transport configuration, mast 117 may be lowered to the horizontal position, drill floor 123 may be retracted, coiled tubing injector 127 may be retracted, and jib 133 may be retracted. In some embodiments, hoisting boom 135 may be positioned in a downward position as depicted in FIG. 3. In some embodiments, when in the transport configuration, coiled tubing rig 100 may be sized such that it complies with one or more transportation regulations. For example and without limitation, in some embodiments, coiled tubing rig 100, when in the transport configuration, may be formed such that it is at most 8'6" (2.59 m) wide and 9'6" (2.9 m) in depth, such that coiled tubing rig is a non-permit load. In some embodiments, coiled tubing rig 100 may be transported using trailer 103 by a truck (not shown). In some embodiments, coiled tubing rig 100 may be transported to a position proximate wellhead 15 into which coiled tubing is to be inserted.

To deploy coiled tubing rig 100, drill floor 123 may be positioned by, for example and without limitation, drill floor hydraulic cylinder 125 as depicted in FIG. 4. In some embodiments, hoisting boom 135 may be positioned in an upward position. Mast 117 may be raised into the vertical position depicted in FIG. 2 by pivoting at mast pivot 119. In some embodiments, mast 117 may be secured in the vertical position with guy wire 137. In some embodiments, mast 117 may be raised utilizing hydraulic cylinder 121. In some embodiments, tubing guide arch 131 may be extended.

In some embodiments, coiled tubing injector 127 may be deployed as depicted in FIG. 1. In some embodiments, jib 133 may be deployed by telescoping or pivoting. Once in the deployed position as depicted in FIGS. 1, 5, coiled tubing rig 100 may be utilized to perform coiled tubing operations of wellbore 16. In some embodiments, BOP 109 may be lifted out of BOP cradle 107 utilizing one or more lines or couplers coupled to hoisting boom 135. In some embodiments, BOP 109 may remain coupled to BOP control unit 115 during transport and during rig up operations.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A coiled tubing rig comprising:

a skid;

a mast pivotably coupled to the skid at a mast pivot, the mast positioned out of alignment with a wellhead, the mast moveable between a horizontal position and a vertical position, the mast traversing within a plane defined as a mast pivot plane when moving from the horizontal position to the vertical position;

a coiled tubing injector, the coiled tubing injector directly mechanically coupled to the mast by an injector boom, the coiled tubing injector movable linearly relative to the mast along the injector boom in a horizontal direction between a retracted position and a deployed position, the horizontal direction parallel to the mast pivot plane, the injector boom coupled directly to the mast while the mast is in the horizontal and vertical positions, and the coiled tubing injector coupled directly to the mast by the injector boom while the mast is in the horizontal and vertical positions; and a drill floor pivotably coupled to the mast.

2. The coiled tubing rig of claim 1, wherein the coiled tubing injector extends from the mast such that it is in alignment with the wellhead when in the deployed position.

3. The coiled tubing rig of claim 1, wherein the mast is mechanically coupled to the skid by a hydraulic cylinder.

4. The coiled tubing rig of claim 1, wherein the coiled tubing injector is movable relative to the mast in a vertical direction.

5. The coiled tubing rig of claim 1, further comprising a jib, the jib mechanically coupled to the mast.

6. The coiled tubing rig of claim 5, wherein the jib is pivotably or telescopically coupled to the mast.

7. The coiled tubing rig of claim 5, further comprising a hoisting boom mechanically coupled to the jib.

8. The coiled tubing rig of claim 7, wherein the hoisting boom extends from the jib such that the hoisting boom is aligned with the wellhead.

9. The coiled tubing rig of claim 8, wherein the hoisting boom is pivotably coupled to the jib such that it may move between a retracted and a deployed position, wherein the hoisting boom is in alignment with the wellhead when in the deployed position and is not in alignment with the wellhead when in the retracted position.

10. The coiled tubing rig of claim 1, further comprising a knuckleboom crane, the knuckleboom crane mechanically coupled to the mast.

11. The coiled tubing rig of claim 10, wherein the knuckleboom crane comprises:

a column mechanically coupled to the mast;

an inner boom pivotably coupled to the column;

an outer boom pivotably coupled to the inner boom; and a hoisting fixture supported from the outer boom by a hoisting line.

12. The coiled tubing rig of claim 1, further comprising a BOP cradle.

13. The coiled tubing rig of claim 12, further comprising a BOP control unit positioned on the skid.

14. The coiled tubing rig of claim 13, further comprising a BOP, the BOP operatively coupled to the BOP control unit and positioned in the BOP cradle.

15. The coiled tubing rig of claim 1, wherein the skid is mechanically coupled to or formed integrally with a trailer.

16. A method comprising:

providing a coiled tubing rig, the coiled tubing rig positioned in a transport configuration, the coiled tubing rig including:

a skid;

a mast pivotably coupled to the skid at a mast pivot, the mast positioned in a horizontal position;

a coiled tubing injector, the coiled tubing injector directly mechanically coupled to the mast by an injector boom, the coiled tubing injector slidable relative to the injector boom from a retracted position to a deployed position; and a drill floor mechanically coupled to the mast;

transporting the coiled tubing rig to a wellhead of a wellbore;

extending the drill floor from a retracted position to a deployed position;

raising the mast from the horizontal position to a vertical position such that the mast is positioned out of alignment with the wellhead, the mast traversing within a plane defined as a mast pivot plane; and moving the coiled tubing injector from the retracted position to the deployed position linearly along the injector boom in a horizontal direction parallel to the mast pivot plane such that the coiled tubing injector is in alignment with the wellhead.

17. The method of claim 16, further comprising injecting a coiled tubing string into the wellbore with the coiled tubing injector.

18. The method of claim 16, wherein the mast is mechanically coupled to the skid by a hydraulic cylinder, and raising the mast from a horizontal position to a vertical position comprises extending the hydraulic cylinder.

19. The method of claim 16, wherein the drill floor is mechanically coupled to the mast by a drill floor hydraulic cylinder, and extending the drill floor comprises extending the drill floor hydraulic cylinder.

20. The method of claim 16, wherein moving the coiled tubing injector comprises sliding the coiled tubing injector relative to the injector boom.

21. The method of claim 16, wherein the coiled tubing rig further comprises a jib, and the method further comprises deploying the jib.

22. The method of claim 21, wherein deploying the jib comprises pivoting the jib relative to the mast at a jib pivot.

23. The method of claim 21, wherein deploying the jib comprises extending the jib from the mast telescopically.

24. The method of claim 21, wherein the coiled tubing rig further comprises a hoisting boom mechanically coupled to the jib, and the method further comprises:

moving the coiled tubing injector into the retracted position out of alignment with the wellhead;

hoisting a piece of wellbore equipment into alignment with the wellhead using the hoisting boom;

positioning the piece of wellbore equipment in the wellbore; and moving the coiled tubing injector into the extended position.

25. The method of claim 24, further comprising coupling the piece of wellbore equipment to the coiled tubing string.

26. The method of claim 16, wherein the coiled tubing rig further comprises:

a BOP, the BOP positioned in a BOP cradle during transport; and a BOP hoist system, the BOP hoist system mechanically coupled to the drill floor;

wherein the method further comprises lifting the BOP using the BOP hoist system and positioning the BOP above the wellhead using the BOP hoist system.

* * * * *